US007648390B2

(12) United States Patent
Zhang et al.

(10) Patent No.: US 7,648,390 B2
(45) Date of Patent: Jan. 19, 2010

(54) ELECTRICAL CONNECTOR HAVING INDIVIDUAL SHELL

(75) Inventors: Dao-Kuan Zhang, Kunshan (CN); Qing Wan, Kun Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/470,591

(22) Filed: May 22, 2009

(65) Prior Publication Data

US 2009/0298338 A1 Dec. 3, 2009

(30) Foreign Application Priority Data

May 29, 2008 (CN) ..... 2008 2 0037491

(51) Int. Cl.
*H01R 13/66* (2006.01)

(52) U.S. Cl. ..... 439/541.5; 439/607.23; 439/607.25; 439/607.26; 439/607.55

(58) Field of Classification Search ..... 439/541.5, 439/607.23–607.26, 607.53–607.55, 607.38
See application file for complete search history.

(56) References Cited

U.S. PATENT DOCUMENTS

| | | | | |
|---|---|---|---|---|
| 6,368,151 | B1 * | 4/2002 | Chen et al. | 439/541.5 |
| 6,685,504 | B1 | 2/2004 | Espenshade | |
| 6,910,917 | B2 * | 6/2005 | Chen | 439/541.5 |
| 7,410,391 | B2 * | 8/2008 | Wan et al. | 439/607.01 |

* cited by examiner

*Primary Examiner*—Tho D Ta
(74) *Attorney, Agent, or Firm*—Ming Chieh Chang; Wei Te Chung; Andrew C. Cheng

(57) ABSTRACT

An electrical connector (100) includes an insulative housing (10), a number of first contacts (20), a contact module (30) and a metallic shell (40). The insulative housing has a mating face (14), a first receiving cavity (15) and a second receiving cavity (16) recessed from the mating face. The first contacts are disposed in the insulative housing. The contact module is received in the second receiving cavity and has an insulative base (31), a number of second contacts (32) and a shielding plate (33). The metallic shell is attached to the mating face of the insulative housing and having a plate section (41) defining a central opening (410) in alignment with the first receiving cavity, and a pair of opposite ends (42) extending from the plate section and inserted in the insulative housing. The metallic shell has electrical connection with the shielding plate of the contact module.

14 Claims, 6 Drawing Sheets

ELECTRICAL CONNECTOR HAVING INDIVIDUAL SHELL

BACKGROUND OF THE INVENTION

1. Field of the Invention

The present invention relates to an electrical connector, and more particularly to an electrical connector having individual shell for shielding against electromagnetic interference (EMI).

2. Description of the Prior Art

To protect an electrical connector from EMI, a conventional connector assembly for transmitting high speed signal usually includes a connector unit with a shielding plate received in an receiving cavity and an outer shell enclosing the connector assembly. Such as U.S. Pat. No. 6,685,504 issued to Espenshade on Feb. 3, 2004 discloses an electrical connector including an insulative housing defining a first receiving cavity and a second receiving cavity, a plurality of terminals disposed in the first receiving cavity, a contact unit received in the second receiving cavity with a shielding plate envelopping thereon, and an outer shell enclosing the insulative housing. The outer shell enclosing the insulative housing includes a top wall and opposite side walls. The top wall and opposite side walls define a chamber for substantially enclosing the insulative housing. The top wall has a bent section defining a plurality of holes thereon, and each side wall has a plurality of latches formed thereon for engaging with a corresponding hole of the top wall and securing the top wall to the side walls. The side walls have a plurality of grounding tails for electrically connecting to a printed circuit board.

However, the outer shell is made of metallic material and should have enough length and width for enclosing the insulative housing. It requires a great quantity of metallic material for forming the outer shell, so the cost of manufacturing the electrical connector is inevitably high. Furthermore, the top wall and side walls of the outer shell should be connected together via the engagement between the latches and the holes of the outer shell. It is a complicated process of manufacturing the outer shell.

Hence, an improved electrical connector with improved shielding is needed to solve the above problem.

BRIEF SUMMARY OF THE INVENTION

An object of the present invention is to provide an electrical connector in which each connector unit is shielded with an individual metallic shell and interconnected to each other to reduce metallic material and ease the processing of manufacture.

In order to achieve the object set forth, an electrical connector includes an insulative housing, a plurality of first contacts, a contact module and a metallic shell. The insulative housing has a mating face and a first receiving cavity and a second receiving cavity recessed from the mating face. The first contacts are disposed on the insulative housing, and the first contacts having mating portions exposed in the first receiving cavity. The contact module is received in the second receiving cavity. The contact module has an insulative base, a plurality of second contacts disposed in the insulative base and a shielding plate enclosing the insulative base. The metallic shell is attached to the mating face of the insulative housing. The metallic shell has a plate section defining a central opening in alignment with the first receiving cavity, and a pair of opposite ends extending from the plate section and inserted in the insulative housing. The metallic shell has electrical connection with the metallic shell of the contact module.

Advantages of the present invention are to provide an electrical connector having a metallic shell disposed on the mating face of the insulative housing and having electrical connection with the shielding plate of the contact module. Therefore, metallic material of the metallic shell has been reduced, and the cost of manufacturing the electrical connector is economically benefited.

Other objects, advantages and novel features of the invention will become more apparent from the following detailed description of the present embodiments when taken in conjunction with the accompanying drawings.

DETAILED DESCRIPTION OF THE INVENTION

Figure 1:
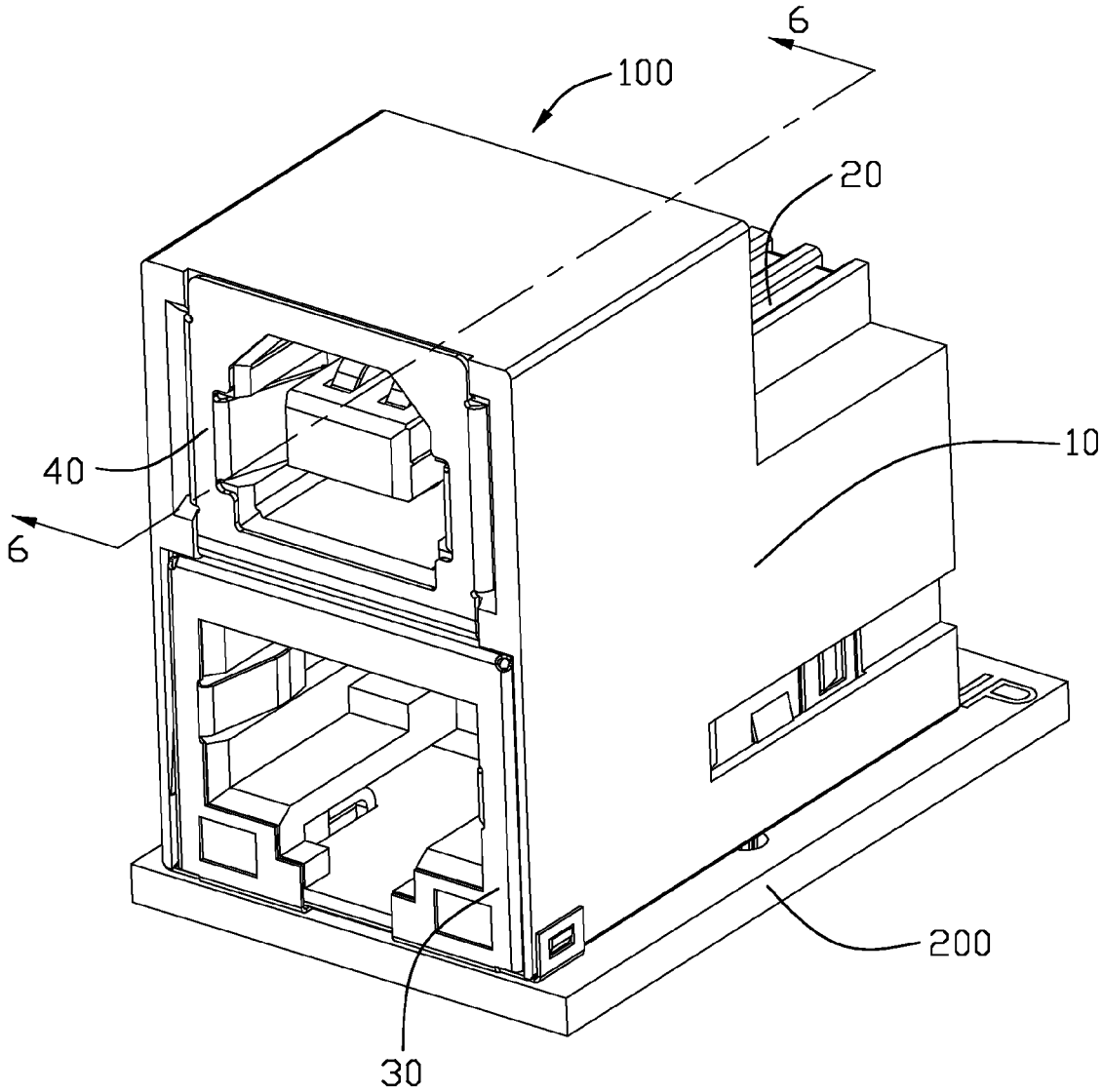
FIG. 1 is an assembled perspective view of an electrical connector mounted on a printed circuit board in accordance with the present invention.

Reference will now be made to the drawing figures to describe the present invention in detail. Referring to FIGS. 1-5, an electrical connector 100 in accordance with the present invention is adapted to be mounted on a printed circuit board 200. The electrical connector 100 includes an insulative housing 10, a plurality of first contacts 20 disposed in the insulative housing 10, a contact module 30 and a metallic shell 40.

Figure 2:
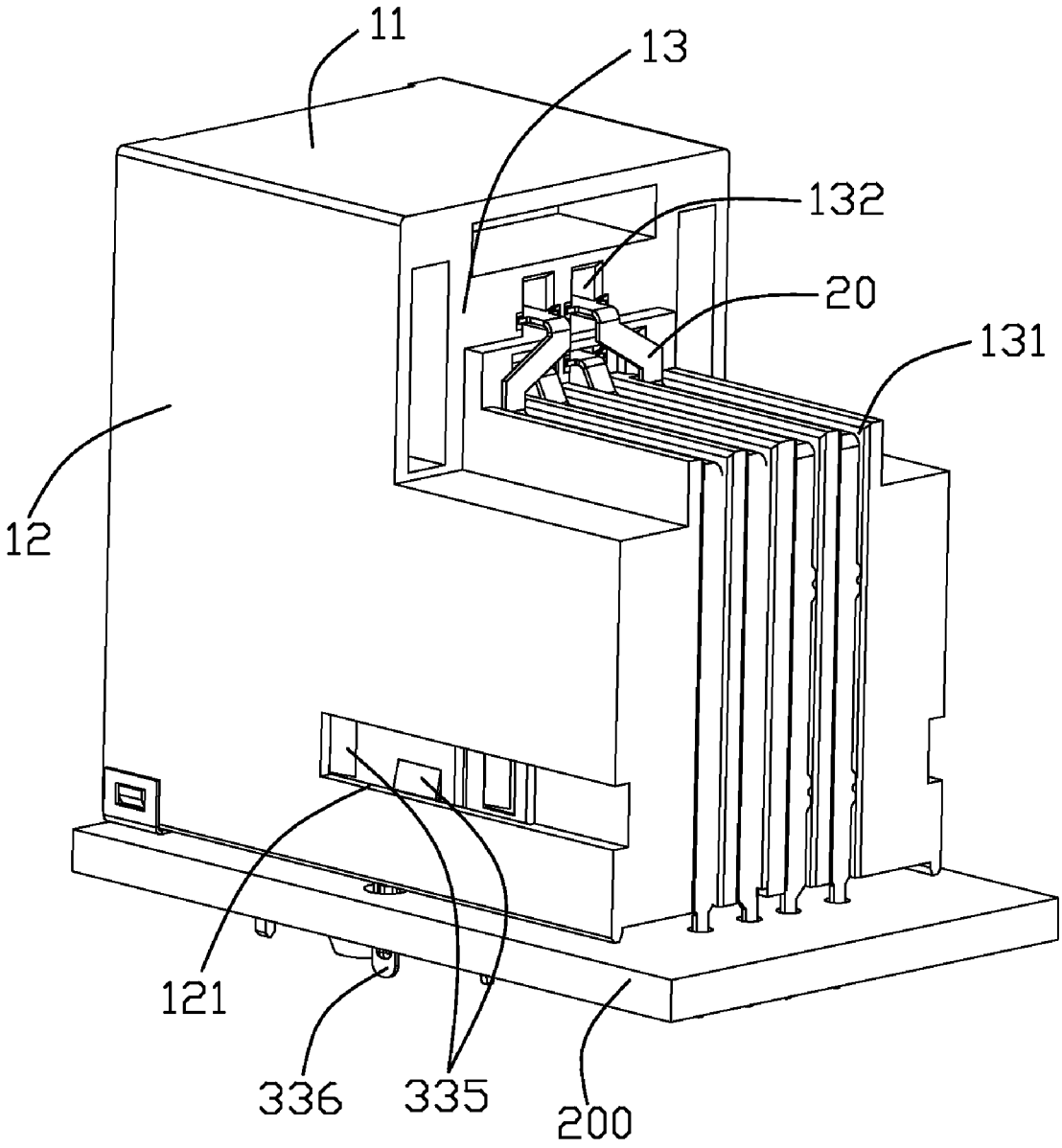
FIG. 2 is an assembled perspective view of the electrical connector mounted on the printed circuit board as shown in FIG. 1, taken from another aspect.
Figure 3:
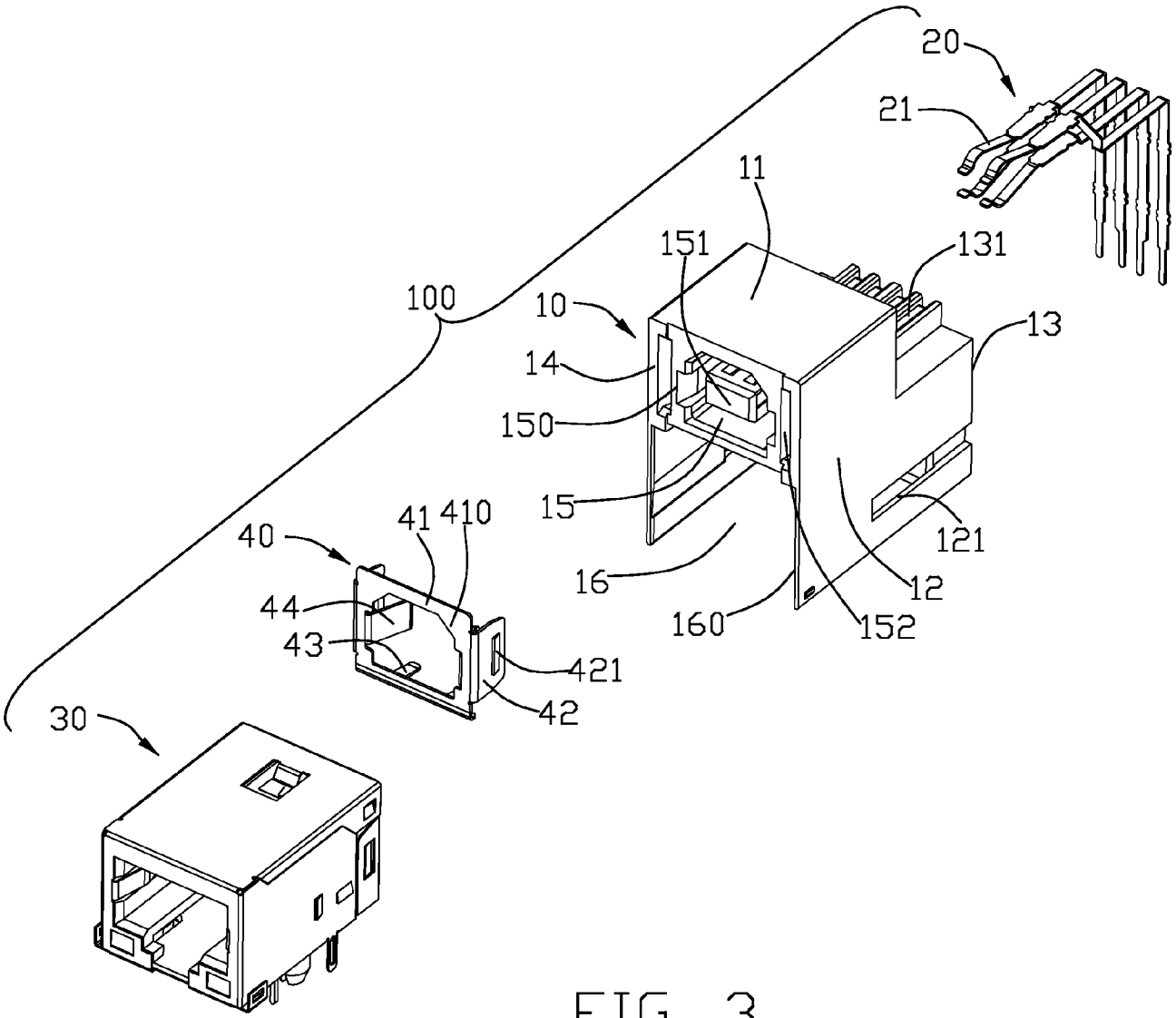
FIG. 3 is an exploded perspective view of the electrical connector as shown in FIG. 1.
Figure 4:
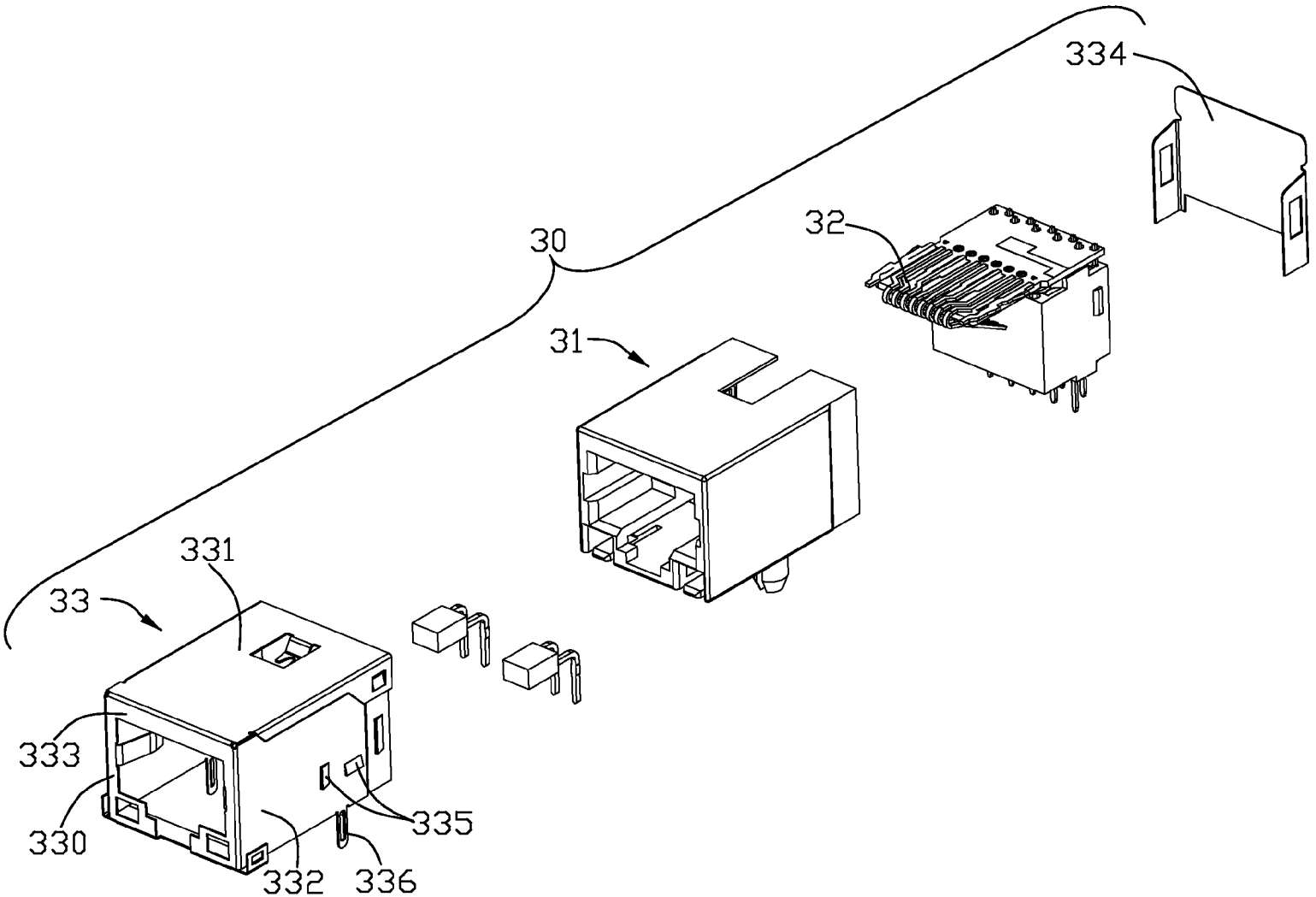
FIG. 4 is an exploded perspective view of a contact module of the electrical connector as shown in FIG. 3.
Figure 6:
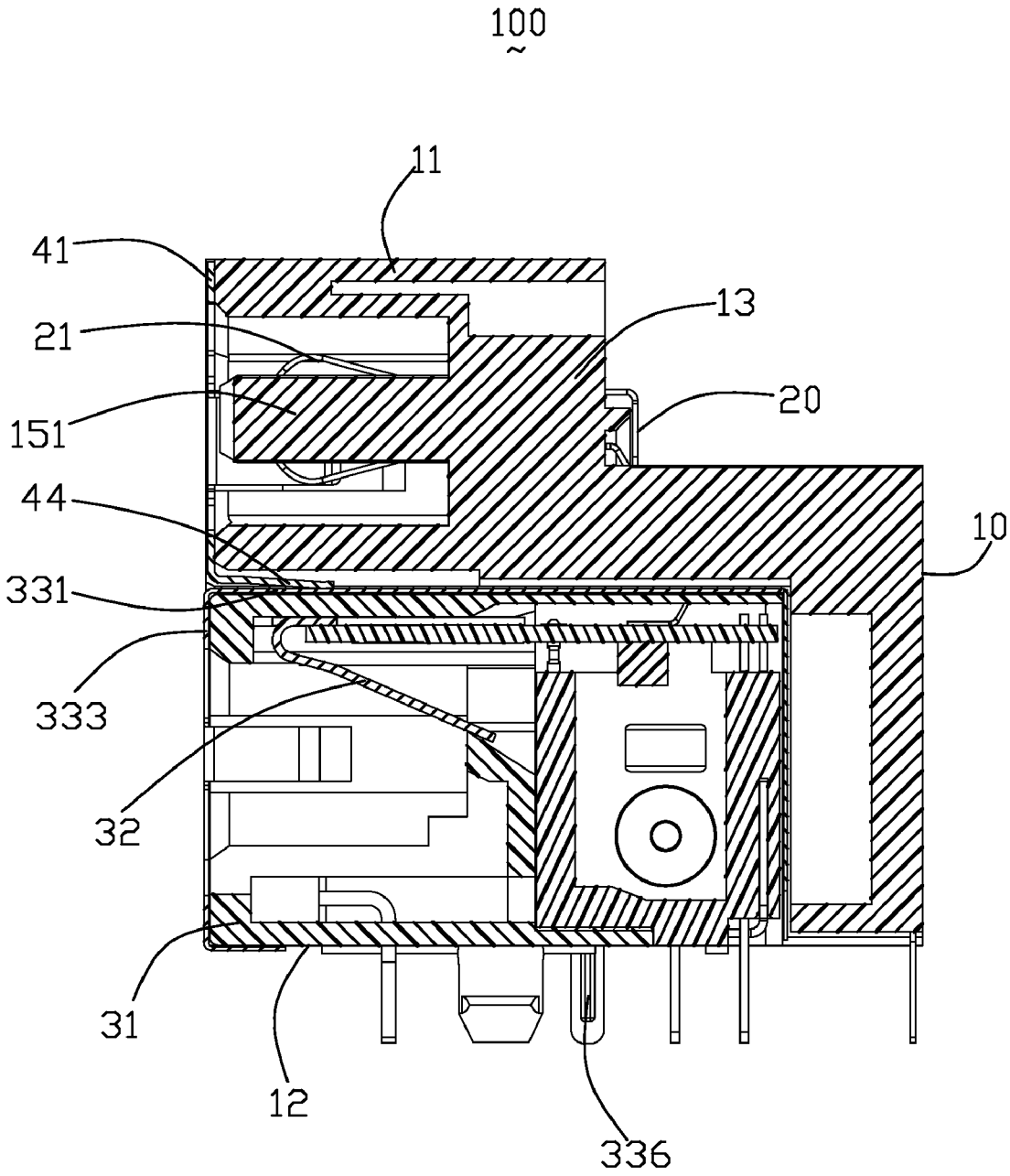
FIG. 6 is a cross-sectional view of the electrical connector as shown in FIG. 1, taken along line 6-6.

Referring to FIGS. 2-3 and 6, the insulative housing 10 has a top wall 11, a pair of side walls 12 and a rear wall 13, and defines a mating face 14. The insulative housing 10 defines a first receiving cavity 15 and a second receiving cavity 16 disposed in a vertical arrangement for receiving a complementary USB connector (not shown) and a complementary RJ-45 connector (not shown) respectively. The first receiving cavity 15 defines a first aperture 150 in the mating face 14, and the second receiving cavity 16 defines a second aperture 160 in the mating face 14. Each side wall 12 has a securing passage 121 defined thereon and communicating with the second receiving cavity 16. The rear wall 13 defines a plurality of terminal passages 131 thereon for securing the first contacts 20, and a plurality of through holes 132 communicating with the first cavity 15 for insertion of the first contacts 20. The insulative housing 10 further has a tongue portion 151 disposed in the first receiving cavity 15 and perpendicular to the rear wall 13. The insulative housing 10 also has a pair of opposite securing slots 152 defined on opposite sides of the first aperture 150.

The first contacts 20 are secured in the terminal passages 131 of the rear wall 13. Each of the first contacts 20 has a mating portion 21 arranged in the tongue portion 151 and exposed in the first receiving cavity 15 for electrically connecting with the corresponding USB connector.

Referring to FIGS. 1, 3-4, and 6, the contact module 30 is received in the second receiving cavity 16 of the insulative housing 10. The contact module 30 includes an insulative base 31, a plurality of second contacts 32 disposed in the insulative base 31 and a shielding plate 33 enclosing the insulative base 31 substantially. The shielding plate 33 includes a top wall 331, opposite side walls 332, a front wall 333 and a rear wall 334. The front wall 333 defines a hole 330 in alignment with the second receiving cavity 16. Each side wall 332 of the shielding plate 33 has a plurality of latching portions 335 formed thereon for engaging with the securing passage 121 of the insulative housing 10 to secure the contact module 30 to the insulative housing 10. The shielding plate 33 further has a plurality of grounding tails 336 formed on a lower edge thereof for electrically connected with the printed circuit board 200.

Figure 5:
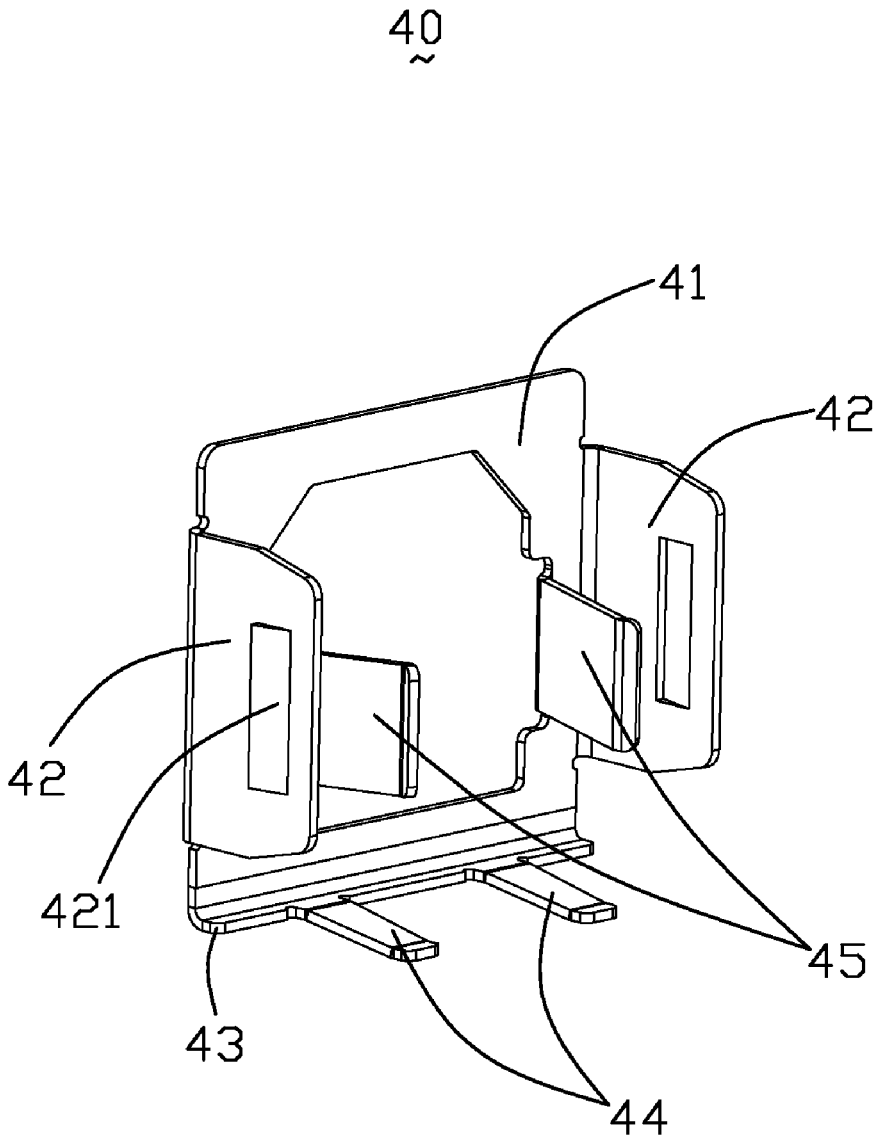
FIG. 5 is a perspective view of a metallic shell of the electrical connector as shown in FIG. 3, taken from another aspect.

Referring to FIGS. 3 and 5, the metallic shell 40 is made of metal material and attached to the mating face 14 of the insulative housing 10. The metallic shell 40 has a plate section 41 defining a central opening 410 in alignment with the first receiving cavity 15, and a pair of opposite ends 42 extending from opposite sides of the plate section 41 and received in the opposite securing slots 152 of the insulative housing 10. Each opposite end 42 has a protruding portion 421 formed thereon for strengthening the engagement between the metallic shell 40 and the insulative housing 10. The metallic shell 40 has a bent section 43 extending from a lower edge of the plate section 41, and a plurality of resilient pieces 44 extending from the bent section 43 and extending into the second receiving cavity 16. The resilient pieces 44 abuts against the top wall 331 of the shielding plate 33 for electrically connecting with the shielding plate 33 of the contact module 30. Thus, an electrically connection between the metallic shell 40 and the shielding plate 33 of the contact module 30 is therefore reliable. The metallic shell 40 further has a plurality of spring arms 45 formed on the plate section 41 and extending into the first receiving cavity 12 of the insulative housing 10 for electrically connecting with the corresponding USB connector.

In another embodiment, the electrically connection between the metallic shell 40 and the shielding plate 33 of the contact module 30 could be realizable via only one resilient piece 44 formed on the metallic shell 40. Furthermore, the electrically connection between the metallic shell 40 and the shielding plate 33 of the contact module 30 could be realizable via one or more resilient pieces (not shown) formed on the shielding plate 33 of the contact module 30.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing having a mating face, a first receiving cavity and a second receiving cavity recessed from the mating face;

a plurality of first contacts disposed in the insulative housing, the first contacts having mating portions exposed in the first receiving cavity;

a contact module received in the second receiving cavity, the contact module having an insulative base, a plurality of second contacts disposed in the insulative base and a shielding plate enclosing the insulative base; and a metallic shell attached to the mating face of the insulative housing and having a plate section defining a central opening in alignment with the first receiving cavity, and a pair of opposite ends extending from the plate section and inserted in the insulative housing, the metallic shell having electrical connection with the shielding plate of the contact module;

wherein said metallic shell has at least one resilient piece extending into the second receiving cavity for electrically connecting with the shielding plate of the contact module.

2. The electrical connector as claimed in claim 1, wherein said metallic shell has a plurality of spring arms formed on the plate section and extending into the first receiving cavity of the insulative housing.

3. The electrical connector as claimed in claim 1, wherein said insulative housing defines a securing passage thereon and communicating with the second receiving cavity, and the shielding plate of the contact module having a latching portion secured in the securing passage of the insulative housing.

4. The electrical connector as claimed in claim 1, wherein said insulative housing has a tongue portion formed in the first receiving cavity, the mating portions of the first contacts arranged on the tongue portion.

5. The electrical connector as claimed in claim 1, wherein said shielding plate of the contact module has at least one grounding tail for electrically connected with a printed circuit board.

6. The electrical connector as claimed in claim 1, wherein said shielding plate of the contact module has a front wall defining a hole corresponding to the second receiving cavity of the housing.

7. The electrical connector as claimed in claim 1, wherein said insulative housing has a pair of opposite securing slots defined on opposite sides of the first receiving cavity for insertion of the opposite ends of the metallic shell.

8. The electrical connector as claimed in claim 7, wherein each of the opposite ends of the metallic shell has a protruding portion formed thereon.

9. An electrical connector, comprising:

an insulative housing having a mating interface arranged in the upper portion of the insulative housing, and defining a receiving cavity under the mating interface, a plurality of contacts disposed within the mating interface, and a metallic shell attached to the mating interface substantially and having a plate section defining a central opening in alignment with the mating interface, and a pair of opposite ends extending from the plate section and inserted in the insulative housing; and a contact module disposed within the receiving cavity and having a shielding plate electrically interconnecting with the metallic shell;

wherein said metallic shell has at least one resilient piece extending into the receiving cavity for electrically connecting with the shielding plate of the contact module.

10. The electrical connector as claimed in claim 9, wherein said contact module has an insulative base and a plurality of second contacts disposed in the insulative base, the shielding plate of the contact module enclosing the insulative base.

11. The stacked connector assembly as claimed in claim 9, wherein said shielding plate of the contact module has a front wall defining a hole corresponding to the receiving cavity of the housing.

12. A stacked connector assembly comprising:

an insulative housing defining an upper mating port into which a tongue portion extends forward from a rear wall of the housing;

two rows of upper contacts respectively disposed in opposite upper and lower surfaces of the tongue portion while upper tails of both said two rows of upper contacts being arranged in only a single row right behind the rear wall, each of said upper tails including a rearward section and a downward section to form an L-shaped configuration thereof for mounting to a printed circuit board;

a lower mating port formed under said upper mating port; a plurality of lower contacts disposed in the lower mating port and defining lower tails for mounting to said printed circuit board; wherein said lower tails are essentially located in a space defined by said rearward sections and said downward sections;

wherein an upper metallic shell attached to the upper mating port and having a plate section defining a central opening in alignment with the mating port, and a pair of opposite ends extending from the plate section and inserted in the insulative housing, the upper metallic shell is mechanically and electrically engaged with a lower metallic shell surrounding the lower mating port.

13. The stacked connector assembly as claimed in claim 12, wherein said lower mating port is defined by a contact module discrete from the housing under condition that the housing defines a lower space in which said contact module is received.

14. The stacked connector assembly as claimed in claim 13, wherein said housing defines a securing passage, and said contact module defines two respective wedged latching portions respectively abutting against a lower side edge and a front side edge of the housing respectively located on a periphery of said passage.

* * * * *